US009291987B2

(12) United States Patent
Choi et al.

(10) Patent No.: US 9,291,987 B2
(45) Date of Patent: Mar. 22, 2016

(54) ELECTROPHOTOGRAPHIC IMAGE FORMING APPARATUS HAVING IMPROVED VIBRATION HANDLING

(71) Applicant: Samsung Electronics Co., Ltd., Suwon-si, Gyeonggi-do (KR)

(72) Inventors: Jung-hoon Choi, Seoul (KR); Hwan-jin Yoon, Suwon-si (KR); Seung-bok Jung, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/461,546

(22) Filed: Aug. 18, 2014

(65) Prior Publication Data

US 2015/0055973 A1 Feb. 26, 2015

Related U.S. Application Data

(60) Provisional application No. 61/869,885, filed on Aug. 26, 2013.

(30) Foreign Application Priority Data

Sep. 10, 2013 (KR) ..... 10-2013-0108626

(51) Int. Cl.
*G03G 21/20* (2006.01)
*G03G 21/16* (2006.01)
*G03G 15/00* (2006.01)

(52) U.S. Cl.
CPC ..... *G03G 21/1619* (2013.01); *G03G 15/6511* (2013.01); *G03G 15/6529* (2013.01); *G03G 21/20* (2013.01)

(58) Field of Classification Search
CPC ..... G03G 15/1605; G03G 5/047; G03G 15/6573; G03G 2215/00675; G03G 5/0596; G03G 5/14795; G03G 15/16; G03G 15/1665; G03G 15/167; G03G 15/2028; G03G 15/2053; G03G 15/5029; G03G 15/6511; G03G 15/06
See application file for complete search history.

(56) References Cited

U.S. PATENT DOCUMENTS 5,734,514 A 3/1998 Han
2006/0159487 A1* 7/2006 Choi et al. ..... 399/113
(Continued)

FOREIGN PATENT DOCUMENTS

JP 2003-191569 7/2003
KR 10-1997-0022380 5/1997

OTHER PUBLICATIONS

International Search Report mailed Oct. 29, 2014 in International Patent Application No. PCT/KR2014/007176.

*Primary Examiner* — Roy Y Yi

(57) ABSTRACT

An electrophotographic image forming apparatus includes a recording medium storage unit in which a recording medium is stored, a pickup unit to pick up the recording medium stored in the recording medium storage unit, a pair of transport rollers being engaged with each other to rotate and transport the recording medium picked up by the pickup unit; an image forming unit to form an image on the recording medium transferred by the pair of transport rollers; and a frame including a first support region to support at least one of the pair of transport rollers, and a second support region to support at least a part of the image forming unit, wherein the frame further includes a vibration blocking slit that is disposed between the first and second support regions to block vibration from being transmitted from the first support region to the second support region.

22 Claims, 14 Drawing Sheets

(56) References Cited

U.S. PATENT DOCUMENTS

2007/0110488 A1 5/2007 Kabata et al.
2009/0169245 A1 7/2009 Sato
2011/0249984 A1 10/2011 Nakazato et al.
2011/0298882 A1 12/2011 Otana et al.

* cited by examiner

1000

ELECTROPHOTOGRAPHIC IMAGE FORMING APPARATUS HAVING IMPROVED VIBRATION HANDLING

CROSS-REFERENCE TO RELATED APPLICATIONS

This application claims the benefit of U.S. Provisional Application No. 61/869,885, filed on Aug. 26, 2013, in the US Patent and Trademark Office, and also claims the benefit of priority under 35 U.S.C. §119 from Korean Patent Application No. 10-2013-0108626, filed on Sep. 10, 2013, in the Korean Intellectual Property Office, the disclosures of which are incorporated herein in their entirety by reference.

BACKGROUND OF THE INVENTION

1. Field of the Invention

One or more embodiments of the present general inventive concept relate to an electrophotographic image forming apparatus capable of maintaining a stable image quality.

2. Description of the Related Art

An electrophotographic image forming apparatus forms a visible toner image on a photoconductor by supplying toner to an electrostatic latent image formed on the photoconductor, transfers the visible toner image to a recording medium, and then prints an image on the recording medium by fusing the transferred visible toner image on the recording medium.

Accordingly, the electrophotographic image forming apparatus may include a pickup unit for picking up the recording medium, a transport unit for transporting the picked up recording medium, an image forming unit for forming an image on the transported recording medium, and a fusing unit for fusing the image on the recording medium. Here, each unit may be supported by a frame.

When the image forming unit is exposed to vibration while the electrophotographic image forming apparatus forms an image, an image quality may deteriorate.

The vibration transmitted to the image forming unit may be generated by the image forming unit itself, or may be generated by a unit other than the image forming unit. For example, vibration may be generated in the transport unit for transporting the recording medium to the image forming unit. The vibration generated in the transport unit may be transmitted to the image forming unit through the frame supporting the transport unit. Accordingly, the image forming unit is instantaneously shaken, and thus it is difficult to maintain a stable image quality.

SUMMARY OF THE INVENTION

One or more embodiments of the present general inventive concept include an electrophotographic image forming apparatus, wherein a transport unit in which vibration is generated and an image forming unit for forming an image are supported by one frame while vibration is blocked from being directly transmitted between the transport unit and the image forming unit.

Additional features and utilities of the present general inventive concept will be set forth in part in the description which follows and, in part, will be apparent from the description, or may be learned by practice of the general inventive concept.

The foregoing and/or other features and utilities of the present general inventive concept may be achieved by providing an electrophotographic image forming apparatus including a recording medium storage unit in which a recording medium is stored, a pickup unit to pick up the recording medium stored in the recording medium storage unit; a pair of transport rollers being engaged with each other to rotate and transport the recording medium picked up by the pickup unit, an image forming unit to form an image on the recording medium transported by the pair of transport rollers, and a frame including a first support region to support at least one of the pair of transport rollers, and a second support region to support at least a part of the image forming unit, wherein the frame further includes a vibration blocking slit that is disposed between the first and second support regions and blocks vibration from being transmitted from the first support region to the second support region.

At least a part of the vibration blocking slit may extend in a direction crossing a direction in which the first support region faces the second support region.

A length of the vibration blocking slit may be 80% to 150% of an axial length of a rotation shaft of the pair of transport rollers.

A distance between the vibration blocking slit and a rotation shaft of the pair of transport rollers may be 1.5% to 30% of an axial length of the rotation shaft of the pair of transport rollers.

One of the pair of transport rollers may be a first transport roller that rotates to transport the recording medium, and the other one of the pair of transport rollers may be a second transport roller that is rotated by the first transport roller.

The second transport roller may be supported by the first support region.

The electrophotographic image forming apparatus may further include a friction unit disposed to face the pickup unit and provide a frictional force to the recording medium transported between the pickup unit and the friction unit, in a direction opposite to a transport direction.

The pair of transport rollers may support the recording medium when a rear edge of the recording medium is released between the pickup unit and the friction unit.

In the frame, the first support region and the second support region may be integrally formed.

The frame may further include a first sub-frame including the first support region, and a second sub-frame including the second support region and separated from the first sub-frame, wherein the first sub-frame and the second sub-frame may be fixed by a fastening member.

The image forming unit may include: a photoconductive member; an exposure unit to irradiate a light to the photoconductive member to form an electrostatic latent image; a developing unit for forming a toner image on the photoconductive member by supplying toner to the photoconductive member where the electrostatic latent image is formed; and a transfer unit for transferring the toner image to a recording medium.

The exposure unit may be supported by the second support region.

The foregoing and/or other features and utilities of the present general inventive concept may also be achieved by providing an image forming apparatus, comprising a transport unit to transport a recording medium, an image forming unit to form an image on the recording medium, and a frame having a first support region to support at least a part of the transport unit, a second support region to support at least a part of the image forming unit, and a vibration blocking portion disposed between first support region and the second support region to block vibration from being transmitted between the first support region and the second support region.

The image forming apparatus may further comprise a reinforcing member disposed in the frame beneath or above the vibration blocking portion and spaced apart from a path of vibration between the first and second support regions.

The frame, first support region and second support region may be integrally formed.

The frame may further comprise a first sub-frame including the first support region and a second sub-frame including the second support region, being fastened to the first sub-frame by a fastening member.

The vibration blocking portion may be a slit disposed in the first sub-frame.

The image forming unit may include an exposure unit to form a latent image on a surface of a photoconductive member, the exposure unit being supported by the second support region.

The transport unit may comprise one or more first transport rollers on a first rotation shaft supported on side frames connected to the frame and one or more second transport rollers on a second rotation shaft supported on the frame.

The vibration blocking portion may be disposed in a direction parallel to the first and second rotation shafts.

The image forming apparatus may further comprise an elastic member having one end supported on the frame and one end in contact with the second rotation shaft such that the second rotation shaft is pressed toward the first rotation shaft.

The foregoing and/or other features and utilities of the present general inventive concept may also be achieved by providing a frame unit of an image forming apparatus, comprising a first support region to support at least a part of a transport unit to transport a recording medium, a second support region to support at least a part of an image forming unit to form an image on the recording medium, and a vibration blocking portion disposed between the first support region and the second support region to block vibration from being transmitted between the first support region and the second support region.

The vibration portion may be a groove formed in a direction crossing a direction in which the first support region faces the second support region.

BRIEF DESCRIPTION OF THE DRAWINGS

These and/or other features and utilities of the present general inventive concept will become apparent and more readily appreciated from the following description of the embodiments, taken in conjunction with the accompanying drawings in which.

DETAILED DESCRIPTION OF THE PREFERRED EMBODIMENTS

Figure 1:
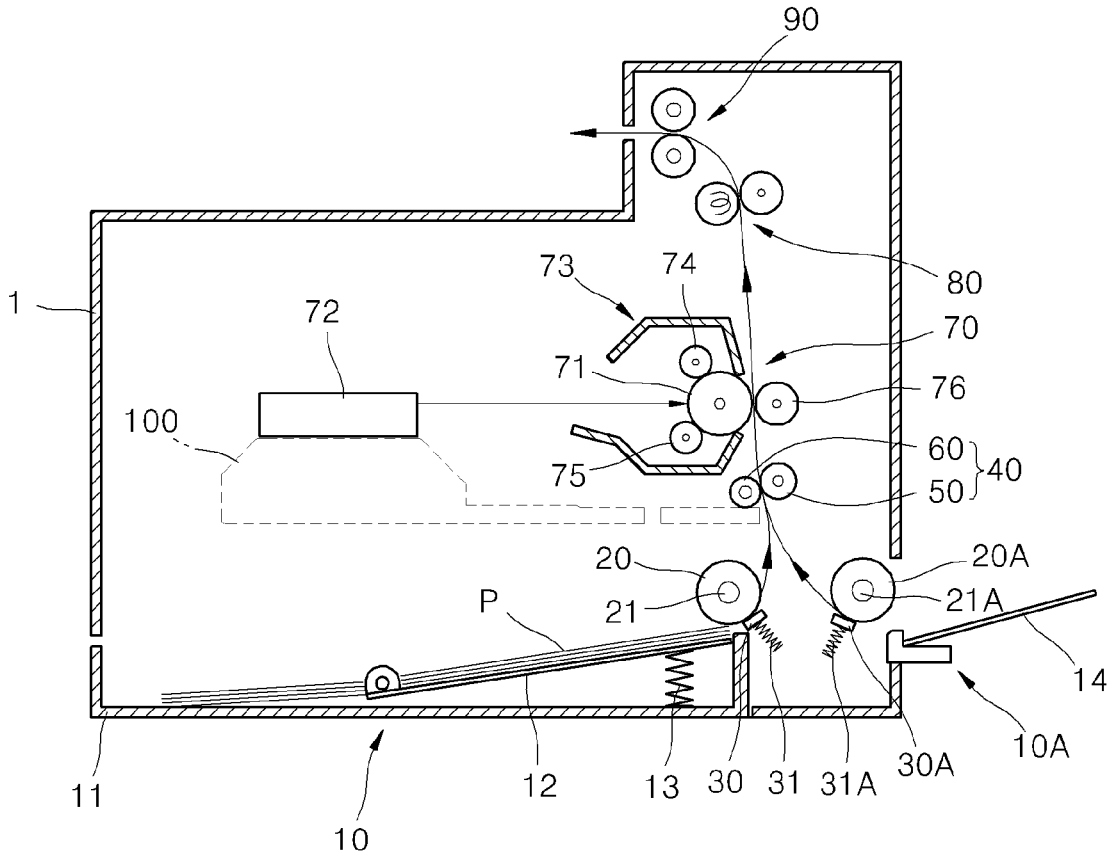
FIG. 1 is a diagram of an electrophotographic image forming apparatus according to an exemplary embodiment of the present general inventive concept.

Reference will now be made in detail to embodiments of the present general inventive concept, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of," when preceding a list of elements, modify the entire list of elements and do not modify the individual elements of the list.

The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

FIG. 1 illustrates an electrophotographic image forming apparatus 1000 according to an exemplary embodiment of the present general inventive concept. The electrophotographic image forming apparatus 1000 may be a monochromic image forming apparatus. A color of toner may be black.

Referring to FIG. 1, the electrophotographic image forming apparatus 1000 includes recording medium storage units 10 and 10A, pickup units 20 and 20A, a friction unit 30, a transport unit 40, an image forming unit 70, a fusing unit 80, and a discharge unit 90.

The recording medium storage units 10 and 10A store a recording medium P, and supply the recording medium P to the electrophotographic image forming apparatus 1000. For example, the recording medium storage unit 10 may include a tray 11 that is detachably attached to a body 1 of the electrophotographic image forming apparatus 1000, and a knock-up plate 12 on which the recording medium P is stacked and enabling the recording medium P to contact the pickup unit 20. The knock-up plate 12 is elastically pressed towards the pickup unit 20 by an elastic member 13. As another example, the recording medium storage unit 10A may include a plate 14 on which the recording medium P is stacked to manually supply the recording medium P.

The pickup unit 20 picks up the recording medium P stored in the recording medium storage unit 10. The pickup unit 20 may be a circular roller. The pickup unit 20 is supported by a rotation shaft 21, and may be elastically transformed to form a nip as an outer circumference of the pickup unit 20 faces the knock-up plate 12. The recording medium P may be withdrawn from the recording medium storage unit 10 as the pickup unit 20 rotates while the outer circumference of the pickup unit 20 contacts the recording medium P.

The friction unit 30 is disposed to face the pickup unit 20. The friction unit 30 is pressed towards the pickup unit 20 by an elastic member 31. The friction unit 30 provides a frictional force to a rear surface of the recording medium P transported between the friction unit 30 and the pickup unit 20, in a direction opposite to a transport direction. Accordingly, when a plurality of recording media P are placed between the friction unit 30 and the pickup unit 20, recording media P other than the recording medium P directly contacting the pickup unit 20 are prevented from being transported. In other words, the plurality of recording media P are prevented from being overlappingly transported to the transport unit 40 at once.

A friction pad is an exemplary method that may be used by the friction unit 30. The friction pad method is a relatively simple method of preventing the recording media P from being overlappingly transported. However, the friction unit 30 may use other methods, such as, for example, a retard roller method or a semi-retard roller method.

In FIG. 1, the pickup unit 20 is shown as a single roller having a partial region in contact with the knock-up plate 12 and another partial region in contact with the friction unit 30, but the present general inventive concept is not limited thereto. Although not shown in FIG. 1, the pickup unit 20 may include a plurality of rollers, for example, a pickup roller and a forward roller, wherein the pickup roller contacts the knock-up plate 12 and the forward roller contacts the friction unit 30.

The transport unit 40 transports the recording medium P picked up by the pickup unit 20 to the image forming unit 70. The transport unit 40 is disposed at a position downstream in the transport direction from the pickup unit 20 to the recording medium P, and transports the recording medium P picked up by the pickup unit 20 towards the image forming unit 70. The transport unit 40 includes a pair of first and second transport rollers 50 and 60 facing each other. The pair of first and second transport rollers 50 and 60 may be engaged with each other and rotate.

At least one of the pair of first and second transport rollers 50 and 60 may rotate by a driving unit (not shown). For example, the first transport roller 50 rotates by receiving a driving force from the driving unit, and the second transport roller 60 may be rotated by the first transport roller 50. The transport unit 40 may perform a registration function of aligning the recording media P, or a feeding function of supplying the recording media P.

The image forming unit 70 may form an image on the recording medium P via an electrophotographic method. The image forming unit 70 includes a photoconductive member 71, an exposure unit 72, a developing unit 73, and a transfer unit 76. The developing unit 73 includes a charging roller 74 and a developing roller 75.

The photoconductive member 71 is a photoconductor on which an electrostatic latent image is formed, and may be obtained by forming a photoconductive and photosensitive layer on an outer circumference of a cylindrical metal pipe.

The charging roller 74 charges a surface of the photoconductive member 71 at a uniform electric potential. A charging bias is applied to the charging roller 74. The charging roller 74 is an example of a charger, and a Corona charger may be used instead of the charging roller 74.

The exposure unit 72 forms an electrostatic latent image by scanning a light modulated according to image information on the surface of the photoconductive member 71 charged at the uniform electric potential. The exposure unit 72 may be, for example, a laser scanning unit (LSU) to scanning a light irradiated from a laser diode on the photoconductive member 71 after biasing the light in a main scanning direction by using a polygon mirror.

The developing roller 75 develops the electrostatic latent image formed on the photoconductive member 71 by supplying toner to the electrostatic latent image. Accordingly, a toner image is formed on the surface of the photoconductive member 71.

The transfer unit 76 is disposed to face the surface of the photoconductive member 71. A transfer bias voltage is applied to the transfer unit 76. The toner image developed on the surface of the photoconductive member 71 may be transferred to the recording medium P while the recording medium P passes between the photoconductive member 71 and the transfer unit 76. A transfer roller may be used as the transfer unit 76, but alternatively, for example, a Corona transfer unit may be used instead of the transfer roller.

The toner image transferred to the surface of the recording medium P by the transfer unit 76 stays on the surface of the recording medium P by electrostatic attraction. By fusing the toner image on the recording medium P as the fusing unit 80 applies heat and pressure to the toner image, a permanent printing image is formed on the recording medium P.

The recording medium P that passed through the fusing unit 80 is discharged outside the electrophotographic image forming apparatus 1000 by the discharge unit 90.

As described above, the recording medium P stored in the recording medium storage unit 10 is transported to the image forming unit 70 through the pickup unit 20 and the transport unit 40, and a predetermined image is formed on the recording medium P while the recording medium P passes through the image forming unit 70.

Figure 2A:
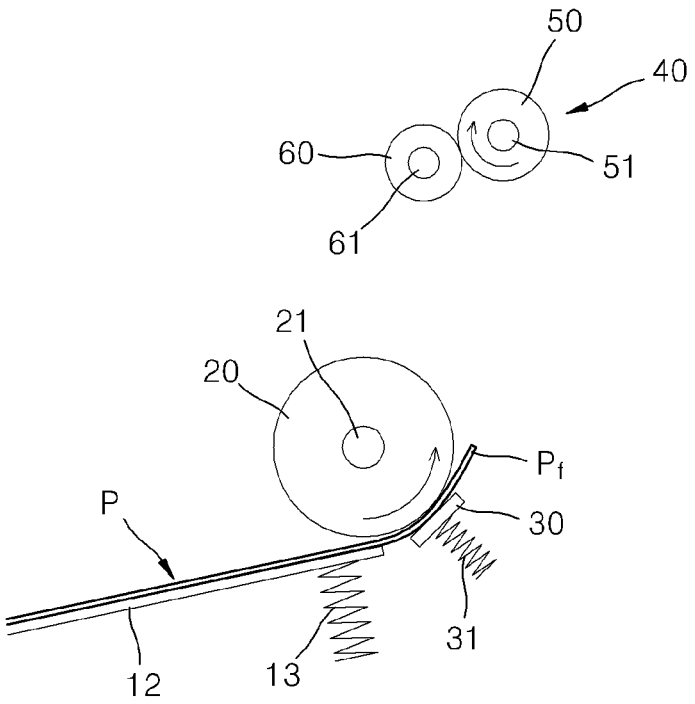
FIGS. 2A through 2C are diagrams illustrating a recording medium being picked up by a pickup unit and transported to a transport unit in the electrophotographic image forming apparatus of FIG. 1 according to an exemplary embodiment of the present general inventive concept.
Figure 2B:
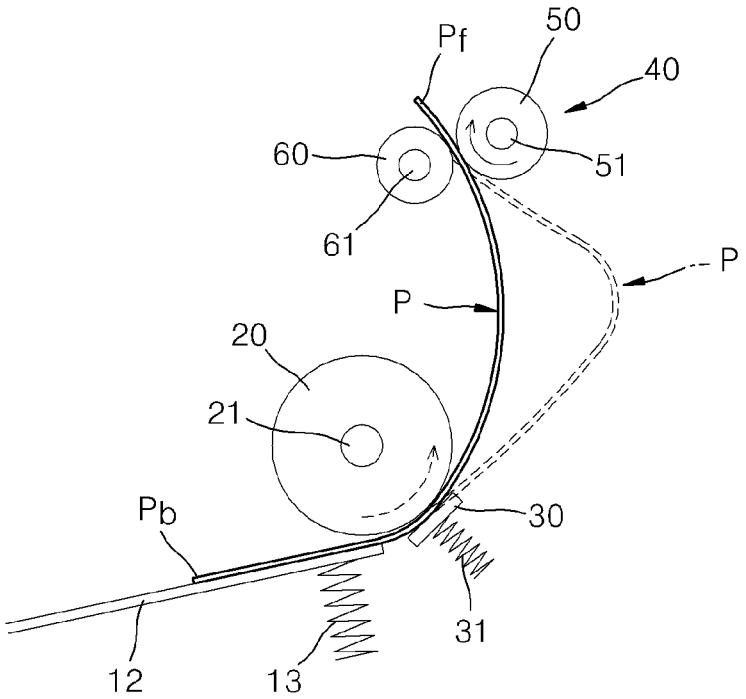
Figure 2C:
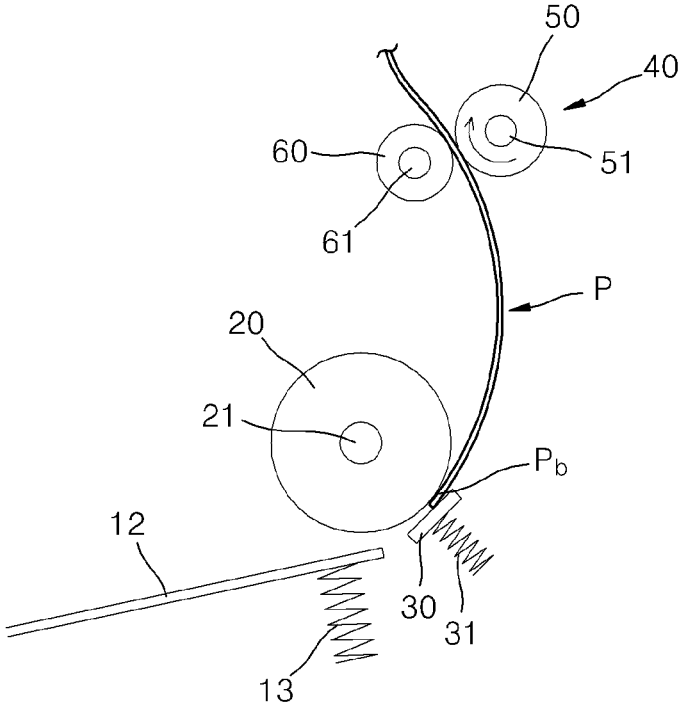

FIGS. 2A through 2C are diagrams showing the recording medium P being picked up by the pickup unit 20 and transported to the transport unit 40 in the electrophotographic image forming apparatus 1000 of FIG. 1. A transport process of the recording medium P and a process of generating vibration in the transport unit 40 during the transport process of the recording medium P will now be described with reference to FIGS. 2A through 2C.

Referring to FIG. 2A, the pickup unit 20 rotates to transport the recording medium P. The pickup unit 20 frictionally-contacts the recording medium P stacked on the knock-up plate 12 to transport the recording medium P towards the transport unit 40. When the recording medium P passes between the pickup unit 20 and the friction unit 30, a frictional force is applied to a rear surface of the recording medium P by the friction unit 30 in a direction opposite to a transport direction. If the plurality of recording media P pass between the pickup unit 20 and the friction unit 30, the recording media P other than the recording medium P directly contacting the pickup unit 20 are prevented from being transported by the frictional force applied by the friction unit 30.

Referring to FIG. 2B, after a front edge $P_f$ of the recording medium P reaches the transport unit 40, a driving signal transmitted to the pickup unit 20 is blocked so as to transport the recording media P one-by-one to the image forming unit 70 at regular intervals. Here, in order to smoothly transport the recording medium P, the transport unit 40 rotates before the front edge $P_f$ of the recording medium P reaches the transport unit 40. When the driving signal is blocked, the pickup unit 20 no longer rotates and idles by the frictional force with the recording medium P transported by the transport unit 40. Here, whether the front edge $P_f$ of the recording medium P reached the transport unit 40 may be detected by any one of various methods. For example, a paper detecting sensor (not shown) may be disposed at a position downstream of the transport unit 40, to detect whether the front edge $P_f$ of the recording medium P reached the transport unit 40.

While the driving signal is transmitted to the pickup unit 20, a transport speed of the transport unit 40 may be faster than a transport speed of the pickup unit 20. Here, a region of the recording medium P disposed between the transport unit 40 and the pickup unit 20 may be loosened as shown by broken lines. Then, when the driving signal transmitted to the pickup unit 20 is blocked, the pickup unit 20 is temporarily stopped. According to the transport unit 40 having a faster transport speed than the pickup unit 20 that is stopped, the loosened region of the recording medium P between the transport unit 40 and the pickup unit 20 is tightened. Since the recording medium P that is tightened is transported by the transport unit 40, the pickup unit 20 contacting the recording medium P idles in a direction shown in a broken arrow by the frictional force between the pickup unit 20 and the recording medium P.

FIG. 2C shows a rear edge $P_b$ of the recording medium P disposed between the pickup unit 20 and the friction unit 30. Referring to FIG. 2C, when the rear edge $P_b$ of the recording medium P transported by the transport unit 40 is released from between the pickup unit 20 and the friction unit 30, the frictional force applied to the rear edge $P_b$ of the recording medium P is suddenly relieved, and thus the recording medium P bounces in a direction opposite to the frictional force of the pickup unit 20 and the friction unit 30. Accordingly, a shock is applied to the transport unit 40 supporting the recording medium P, thereby generating vibration.

Figure 3:
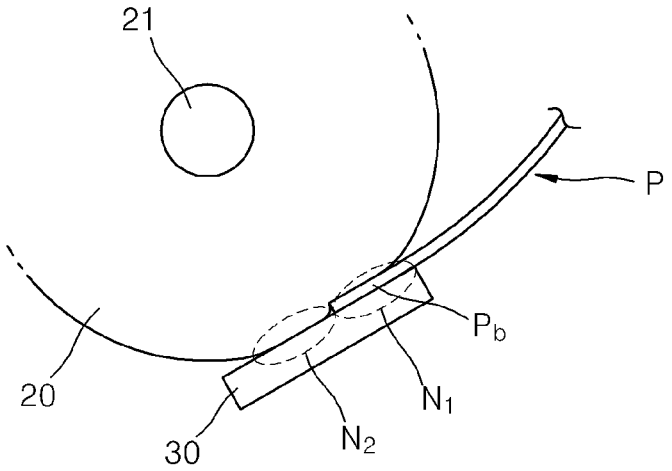
FIG. 3 is a diagram of the recording medium being transported between the pickup unit and a friction unit of FIG. 2C according to an exemplary embodiment of the present general inventive concept.

FIG. 3 is a diagram of the recording medium P being transported between the pickup unit 20 and the friction unit 30 of FIG. 2C. Referring to FIG. 3, a nip is formed between the friction unit 30 and the pickup unit 20 as an outer circumference of the pickup unit 20 is elastically transformed.

The rear edge $P_b$ of the recording medium P is disposed in a region N1 of the nip, and thus the pickup unit 20 and the friction unit 30 do not directly contact each other in the region N1, but the pickup unit 20 and the friction unit 30 directly contact each other in a region N2 of the nip. As such, since the pickup unit 20 and the friction unit 30 directly contact each other in the region N2, the idle of the pickup unit 20 described with reference to FIG. 2B is restricted. In other words, despite the pickup unit 20 contacting the recording medium P transported by the transport unit 40, the pickup unit 20 may instantaneously stop or slowly rotate. When the recording medium P is released from between the friction unit 30 and the pickup unit 20 in such a state, a shock may be applied to the transport unit 40, and thus the transport unit 40 may further vibrate.

The above embodiment is described with an example of vibrations caused by the pickup unit 20 and the friction unit 30, which are disposed adjacent to the tray 11 that is detachably attached to the body 1, but causes of vibration are not limited thereto and may vary. For example, the transport unit 40 may vibrate while the recording medium P is released between the pickup unit 20A and a friction unit 30A, which are disposed adjacent to the plate 14 of the recording medium storage unit 10A of FIG. 1. A reference numeral 31A denotes an elastic member that pressurizes the friction unit 30A, and a reference numeral 21A denotes a rotation shaft of the pickup unit 20A. In another example, the transport unit 40 may vibrate while the recording medium P is released from between the knock-up plate 12 and the pickup unit 20.

Figure 4:
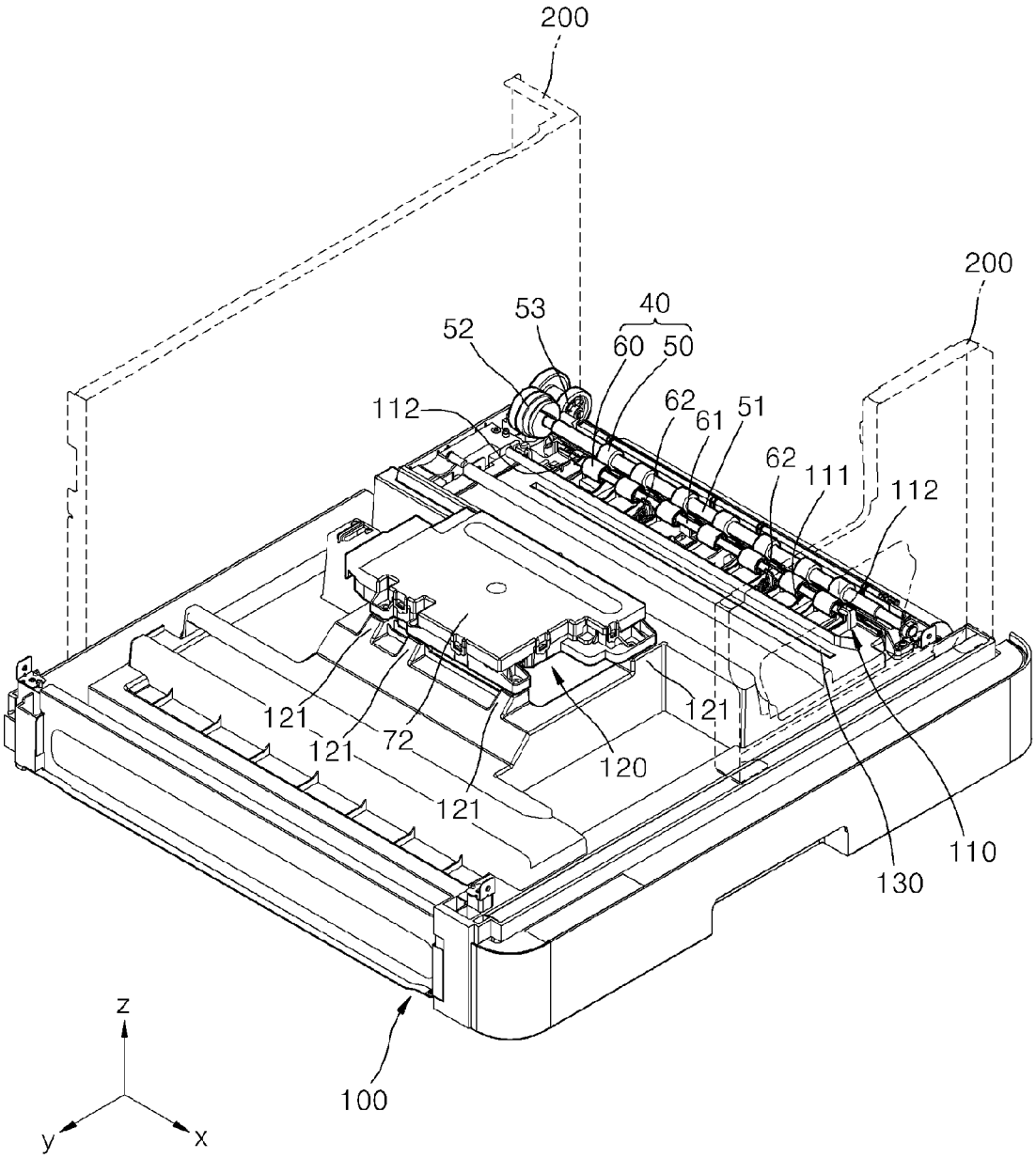
FIG. 4 is an assembly perspective view illustrating the transport unit and an exposure unit of the electrophotographic image forming apparatus of FIG. 1 being assembled to a side frame and a base frame according to an exemplary embodiment of the present general inventive concept.
Figure 5:
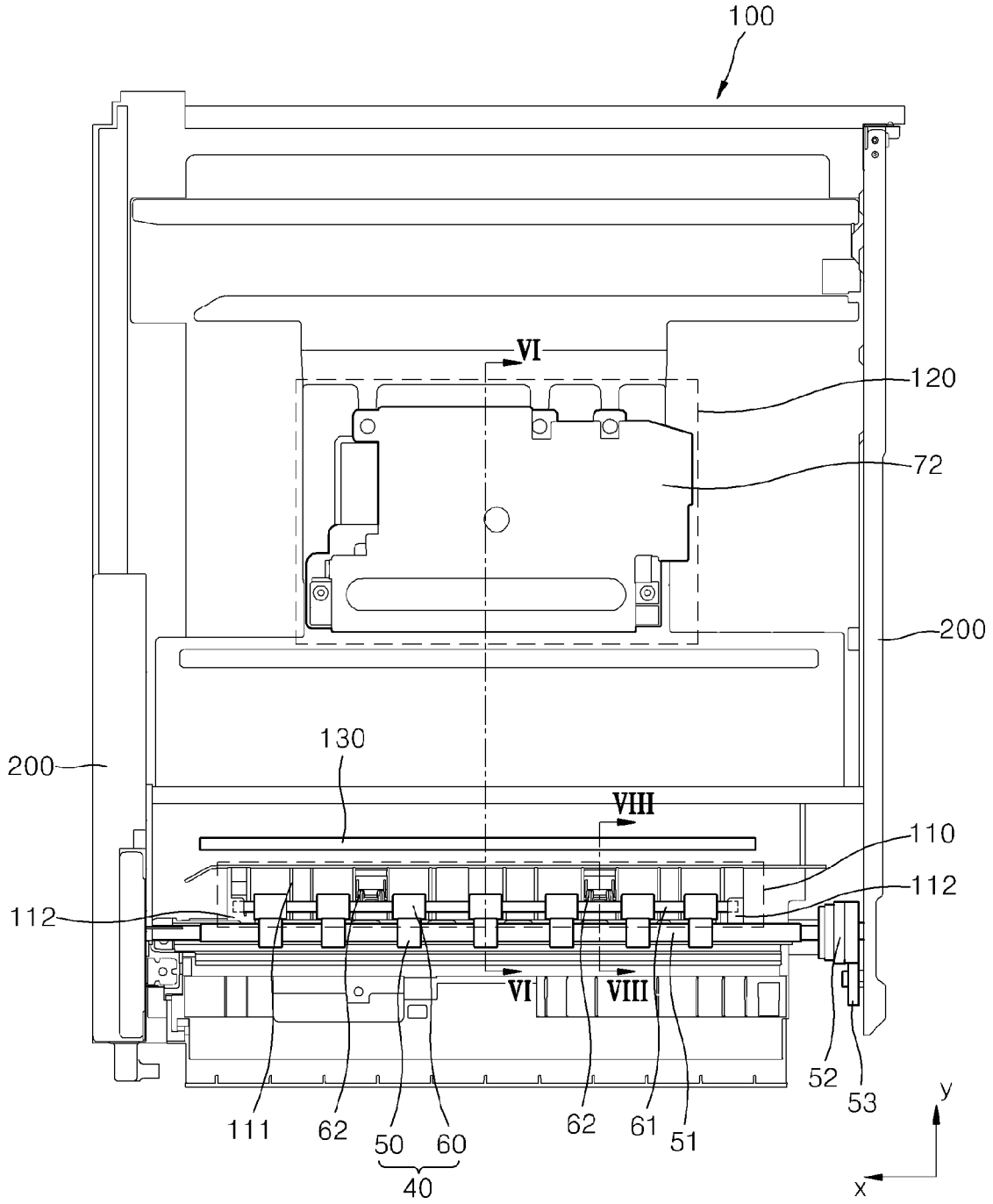
FIG. 5 is a plan view of FIG. 4.

FIG. 4 is an assembly perspective view showing the transport unit 40 and the exposure unit 72 of the electrophotographic image forming apparatus 1000 of FIG. 1 being assembled to a side frame 200 and a base frame 100, and FIG. 5 is a plan view of FIG. 4. A support structure of the transport unit 40 where vibration is generated, and a relationship between the transport unit 40 and the exposure unit 72 will now be described with reference to FIGS. 4 and 5. Here, the exposure unit 72 is used as the image forming unit 70 supported by the base frame 100 that supports the transport unit 40, but the exposure unit 72 may be applied to at least one of the photoconductive member 71, the developing unit 73, and the transfer unit 76, which are other components of the image forming unit 70.

FIGS. 4 and 5 show the side frames 200 supporting the first transport roller 50, and the base frame 100 supporting the second transport roller 60 and the exposure unit 72. The side frames 200 are disposed on two sides of the base frame 100.

A plurality of the first transport rollers 50 are disposed on a rotation shaft 51 at regular intervals. The first transport roller 50 is supported by the rotation shaft 51, and two ends of the rotation shaft 51 are supported by the side frames 200. A driving gear 52 is disposed on at least one of the two ends of the rotation shaft 51 and is connected to a driving gear 53 provided at the side frame 200, thereby receiving a driving force from a driving unit (not shown).

A plurality of the second transport rollers 60 are disposed on a rotation shaft 61 at regular intervals. The plurality of second transport rollers 60 correspond to the plurality of first transport rollers 50. The first and second transport rollers 50 and 60 are pressed and contact each other by an elastic member 62 that pressurizes the rotation shaft 61 of the second transport roller 60. The elastic member 62 may be a spring. A nip is formed between the first and second transport rollers 50 and 60 that contact each other and are pressed together by the elastic member 62, and the recording medium P is transported to the image forming unit 70 of FIG. 1 by a frictional force generated in the nip.

Figure 8:
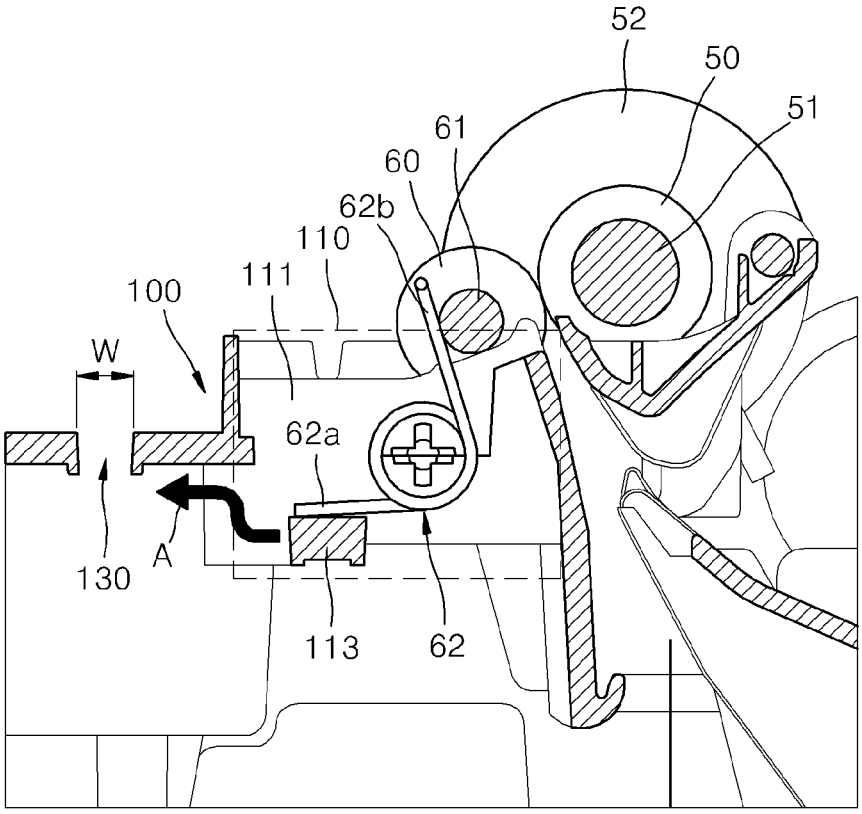
FIG. 8 is a cross-sectional view taken along line VIII-VIII of FIG. 5.

The second transport roller 60 is supported by the rotation shaft 61, and the rotation shaft 61 is supported by the base frame 100. The rotation shaft 61 is pressed towards the first transport roller 50 by the elastic member 62, while a weight of the rotation shaft 61 is supported by a plurality of lower supports 111 formed at the base frame 100. Referring to FIG. 8, an end 62*b* of the elastic member 62 contacts the rotation shaft 61 while an end 62*a* of the elastic member 62 is fixed to the base frame 100. Two ends of the rotation shaft 61 are inserted into side supports 112 formed at the base frame 100. A location of the rotation shaft 61 is restricted by the side supports 112.

Vibration generated in the first and second transport rollers 50 and 60 when the recording medium P is released from between the pickup unit 20 and the friction unit 30 is transported to the side frames 200 supporting the rotation shaft 51 of the first transport roller 50 and to the base frame 100 supporting the rotation shaft 61 of the second transport roller 60.

A shock applied to the first transport roller 50 is transmitted to the side frames 200 along the rotation shaft 51. Vibration transmitted to the side frames 200 may be transmitted to the base frame 100 which is fixed and connected to the side frames 200, but may considerably disappear while being transmitted along the side frames 200. Thus, the vibration does not actually affect the exposure unit 72 supported by the base frame 100.

Vibration applied to the second transport roller 60 is transmitted to the base frame 100 along the rotation shaft 61. In detail, since the rotation shaft 61 of the second transport roller 60 is supported by the elastic member 62 providing an elastic force towards the first transport roller 50, vibration is transmitted to the base frame 100 along the elastic member 62.

The second transport roller 60 and the exposure unit 72 may be supported by the base frame 100. The base frame 100 includes a first support region 110 for supporting the second transport roller 60 and a second support region 120 for supporting the exposure unit 72. The lower support 111 to supporting the rotation shaft 61 of the second transport roller 60, the side support 112, and a support 113 to supporting the elastic member 62 may be formed in the first support region 110. A plurality of supports 121 to supporting the exposure unit 72 may be formed in the second support region 120.

As such, when the second transport roller 60 and the exposure unit 72 are supported by the base frame 100, vibration generated in the second transport roller 60 needs to be blocked from being transmitted to the exposure unit 72. If the vibration generated in the second transport roller 60 is transmitted to the exposure unit 72, the exposure unit 72 vibrates, and thus an electrostatic latent image formed on the photoconductive member 71 may be affected.

In order to prevent the vibration generated in the second transport roller 60 from being directly transmitted to the exposure unit 72 along the base frame 100, a vibration blocking slit 130 may be formed between the first and second support regions 110 and 120.

The vibration blocking slit 130 has a function of blocking vibration transmitted from the second transport roller 60 to the first support region 110 from being directly transmitted to the second support region 120. The vibration blocking slit 130 may be formed by removing a partial region of the base frame 100 on a path where vibration is directly transmitted from the first support region 110 to the second support region 120, thereby preventing the vibration from being directly transmitted to the second support region 120. By using the vibration blocking slit 130, the vibration transmitted to the second support region 120 detours at the vibration blocking slit 130, and may considerably disappear. Accordingly, an image quality is prevented from being deteriorated due to vibration of the exposure unit 72.

The vibration blocking slit 130 may be formed in a direction crossing a direction in which the first support region 110 faces the second support region 120. For example, the vibration blocking slit 130 may extend in a direction (x-axis direction) perpendicular to a direction (y-axis direction) in which the first support region 110 faces the second support region 120.

Figure 6:
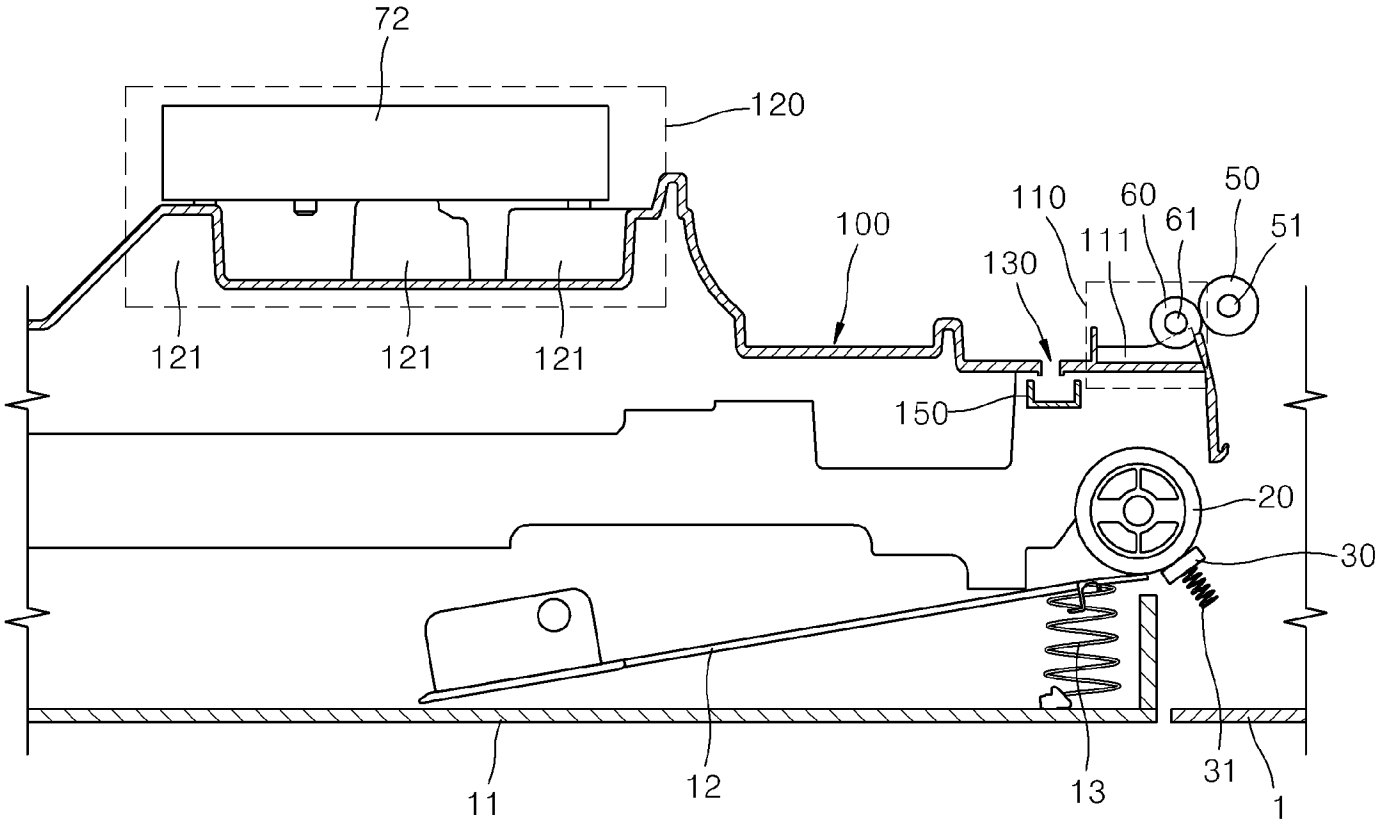
FIG. 6 is a cross-sectional view taken along line VI-VI of FIG. 5, according to an exemplary embodiment of the present general inventive concept.
Figure 7:
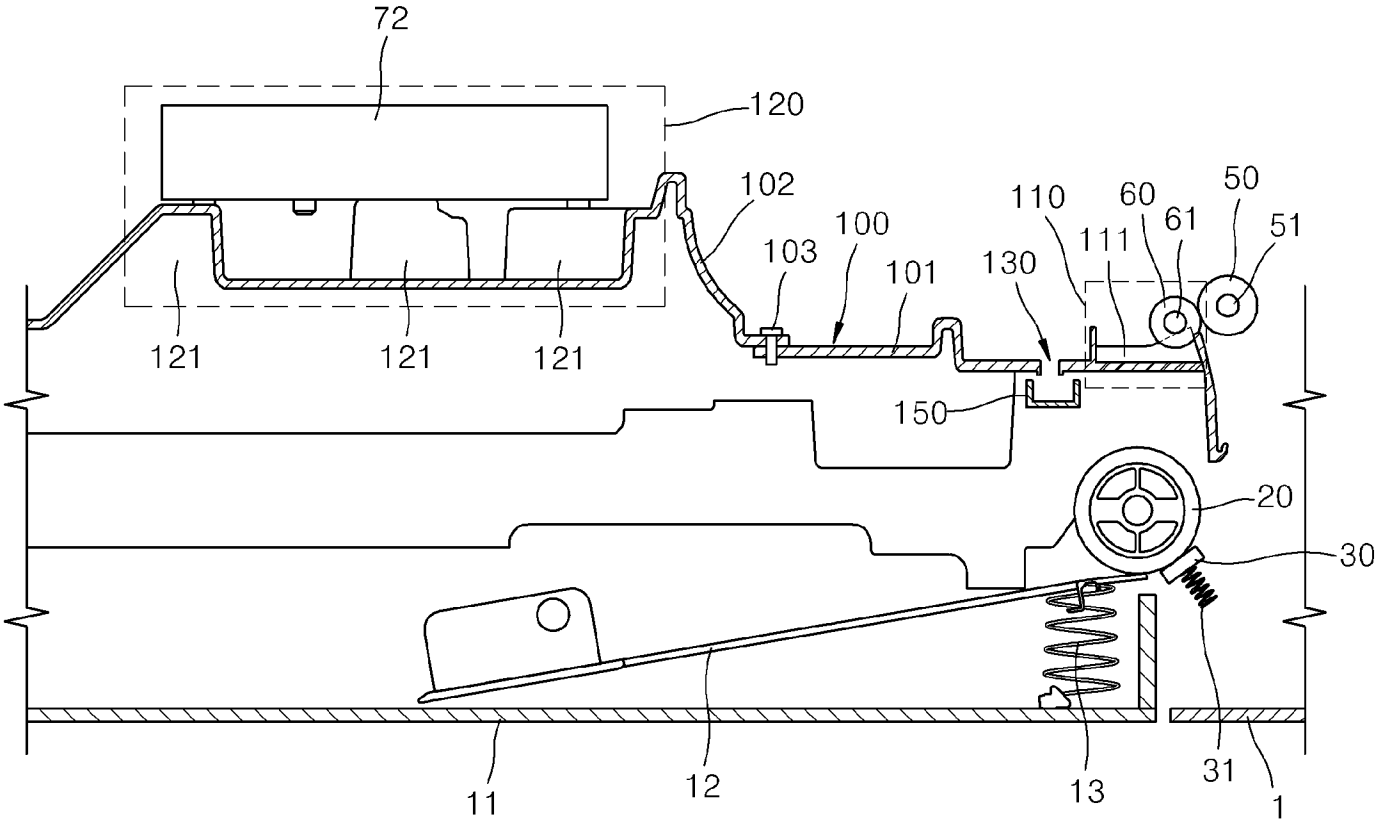
FIG. 7 is a cross-sectional view taken along line VI-VI of FIG. 5, according to another exemplary embodiment of the present general inventive concept.

FIG. 6 is a cross-sectional view taken along line VI-VI of FIG. 5, according to an exemplary embodiment of the present general inventive concept, FIG. 7 is a cross-sectional view taken along line VI-VI of FIG. 5, according to another exemplary embodiment of the present general inventive concept, and FIG. 8 is a cross-sectional view taken along line VIII-VIII of FIG. 5.

Referring to FIG. 6, the second transport roller 60 is supported in the first support region 110 of the base frame 100, and the exposure unit 72 is supported in the second support region 120.

The base frame 100 may connect the first and second support regions 110 and 120 directly to each other without using the side frames 200. For example, as shown by FIG. 6, in the base frame 100, the first and second support regions 110 and 120 may be integrally formed. Alternatively, the first and second support regions 110 and 120 may be connected to each other. For example, as shown by FIG. 7, the base frame 100 may include a first sub-frame 101 including the first support region 110 and a second sub-frame 102 including the second support region 120 and separated from the first support region 101, wherein the first and second sub-frames 101 and 102 are fixed by a fastening member 103. The fastening member 103 may be a bolt, but is not limited thereto. The vibration blocking slit 130 may be disposed within the first sub-frame 101 in order to further isolate the second support region from vibrations.

Referring back to FIG. 6, the first support region 110 includes the lower support 111 protruding upward and supporting a weight of the rotation shaft 61 of the second transport roller 60. The second support region 120 includes the support 121 protruding upward and supporting the exposure unit 72. The vibration blocking slit 130 is formed between the first and second support regions 110 and 120, and blocks vibration from being directly transmitted from the first support region 110 to the second support region 120.

A reinforcing member 150 may be provided at the base frame 100, for example, disposed above or below and parallel to the vibration blocking slit 130. By using the reinforcing member 150, an intensity of the base frame 100 may be prevented from being deteriorated when the vibration blocking slit 130 is formed. Here, in order to prevent vibration blocked by the vibration blocking slit 130 from being transmitted through the reinforcing member 150, the reinforcing member 150 may be disposed spaced apart from a path of vibration between the first support region 110 and second support region 120.

Referring to FIG. 8, the rotation shaft 61 of the second transport roller 60 is pressed towards the first transport roller 50 by the elastic member 62. While the end 62*a* of the elastic member 62 is supported by the support 113 of the base frame 100, the end 62*b* contacts the rotation shaft 61 of the second transport roller 60, thereby pressing the rotation shaft 61 of the second transport roller 60. Since the second transport roller 60 is pressed towards the first transport roller 50 by an elastic force of the elastic member 62, when vibration is generated in at least one of the first and second transport rollers 50 and 60, a shock is transmitted to the base frame 100 through the elastic member 62.

Vibration may be partially absorbed by the elastic member 62 while the vibration is transmitted to the base frame 100 through the elastic member 62. However, since the elastic member 62 strongly presses the rotation shaft 61 of the second transport roller 60, the vibration absorbed by the elastic member 62 is extremely small, and most of the vibration is transmitted to the support 113 of the base frame 100. Vibration transmitted to the support 113 may be transmitted in a direction indicated by an arrow A along the base frame 100, but the vibration transmitted in the direction indicated by the arrow A along the base frame 100 is blocked by the vibration blocking slit 130 having a width W.

Figure 9:
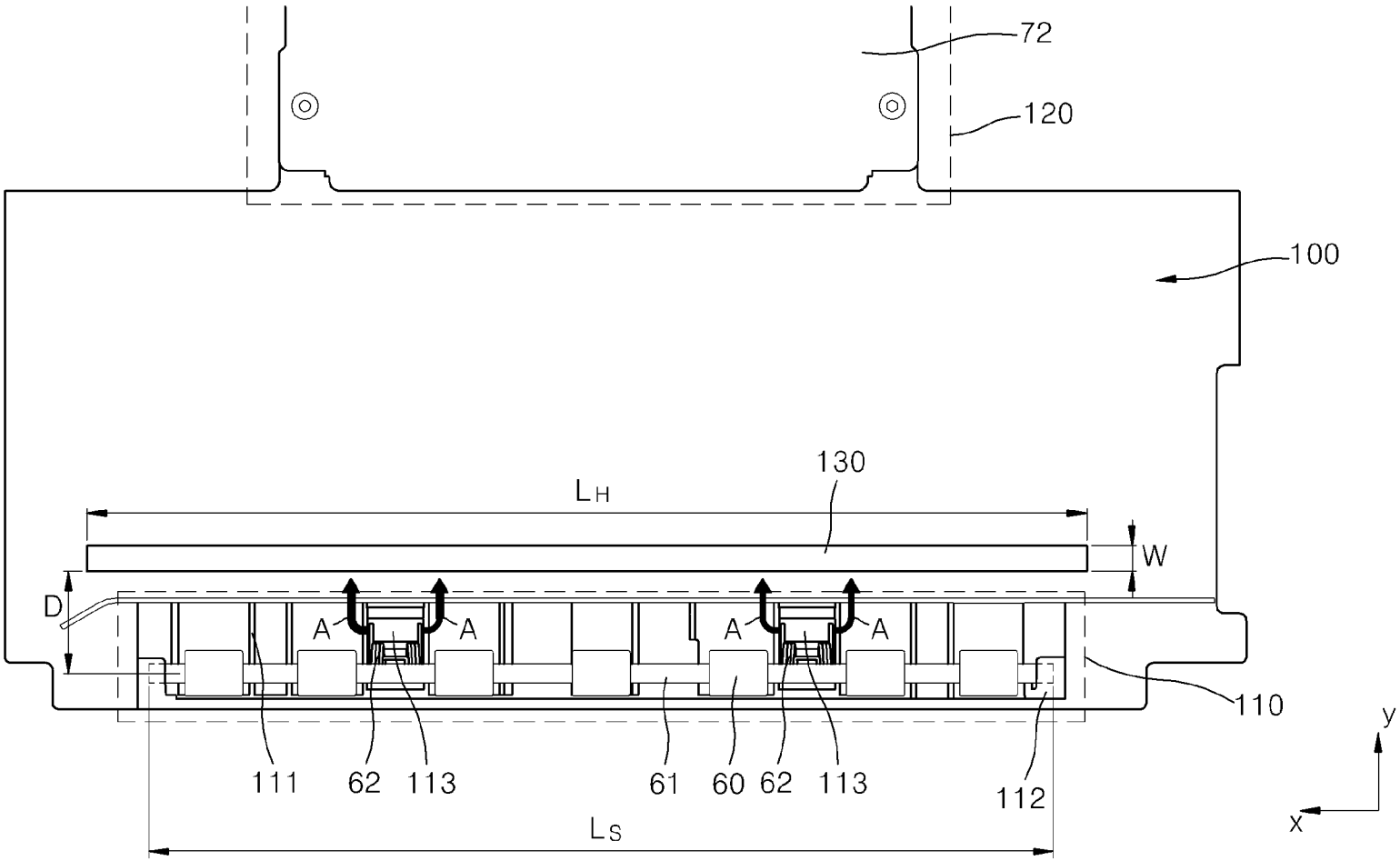
FIG. 9 is a diagram illustrating a process of a base frame blocking vibration transmission according to an exemplary embodiment of the present general inventive concept.

FIG. 9 is a diagram for describing a process of the base frame 100 blocking vibration transmission, and showing a part of the base frame 100 of FIG. 5. Referring to FIG. 9, vibration generated in the second transport roller 60 is transmitted to the elastic member 62, and the vibration transmitted to the elastic member 62 is transmitted in a direction indicated by arrows A along the base frame 100 through the support 113. The vibration transmitted in the direction indicated by the arrows A is blocked from being directly transmitted to the second support region 120 by the vibration blocking slit 130.

Vibration generated in the first support region 110 may dissipate while detouring the vibration blocking slit 130, and thus does not actually affect the exposure unit 72 supported in the second support region 120.

Also, the vibration generated in the second transport roller 60 may be transmitted to the plurality of lower supports 111 without passing through the elastic member 62. The vibration transmitted to the lower support 111 is also blocked from being directly transmitted to the second support region 120 by the vibration blocking slit 130. Accordingly, the vibration generated in the first support region 110 does not actually affect the exposure unit 72 supported in the second support region 120.

If the vibration blocking slit 130 is not formed in the base frame 100, vibration may be directly transmitted from the first support region 110 to the second support region 120 along the base frame 100, and thus the exposure unit 72 supported in the second support region 120 may vibrate.

However, according to the current embodiment, a shock is blocked from being transmitted by using the vibration blocking slit 130 formed between the first and second support regions 110 and 120, and thus vibration of the exposure unit 72 may be reduced.

Figure 12A:
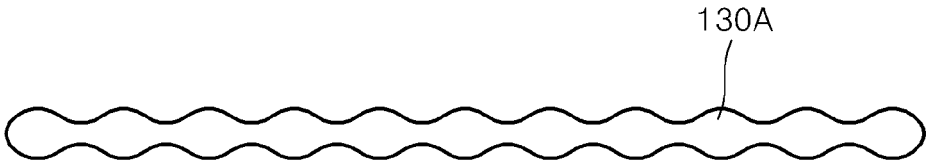
FIGS. 12A and 12B are diagrams of a vibration blocking slit according to exemplary embodiments of the present general inventive concept.
Figure 12B:
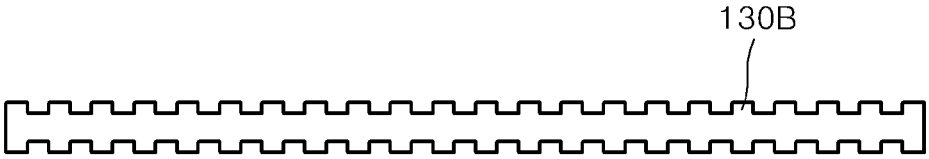

The vibration blocking slit 130 may extend in a direction crossing a direction in which the first support region 110 faces the second support region 120. A shape of the vibration blocking slit 130 may be rectangular as shown by FIG. 9. However, the shape of the vibration blocking slit 130 is not limited thereto, and may vary like vibration blocking slits 130A and 130B of FIGS. 12A and 12B.

Referring back to FIG. 9, a length $L_H$ of the vibration blocking slit 130 may be 80% to 150% of an axial length $L_S$ of the rotation shaft 61 of the second transport roller 60. For example, when the axial length $L_S$ of the rotation shaft 61 of the second transport roller 60 is about 300 mm, the length $L_H$ of the vibration blocking slit 130 may be from about 240 mm to about 450 mm. When the length $L_H$ of the vibration blocking slit 130 is lower than 80% of the axial length $L_S$, it may be difficult to block vibration from being transmitted to the exposure unit 72. In detail, the vibration generated in the second transport roller 60 may be transmitted through the plurality of lower supports 111 supporting the bottom of the second transport roller 60, as well as through the elastic member 62. When the length $L_H$ is lower than 80% of the axial length $L_S$, the vibration transmitted through the lower support 111 may not be blocked and may be transmitted to the second support region 120, and thus the vibration transmitted to the exposure unit 72 may not be effectively blocked. When the length $L_H$ is higher than 150% of the axial length $L_S$, the vibration may be effectively blocked, but a size of the base frame 100 is increased, thereby increasing a size of the electrophotographic image forming apparatus 1000.

The width W of the vibration blocking slit 130 may be from about 0.3 mm to about 200 mm. When the width W is less than 0.3 mm, it may be difficult to form the vibration blocking slit 130. When the width W is higher than 200 mm, a length of an optical path between the exposure unit 72 and the photoconductive member 71 may be increased.

A distance D between the vibration blocking slit 130 and the rotation shaft 61 of the second transport roller 60 may be from about 1.5% to about 30% of the axial length $L_S$. For example, when the axial length $L_S$ is about 300 mm, the distance D may be from about 5 mm to about 90 mm. When the distance D is less than 1.5% of the axial length $L_S$, a space for the first support region 110 may be decreased, and thus it may be difficult to stably support the rotation shaft 61 of the second transport roller 60. When the distance D is higher than 30% of the axial length $L_S$, it is difficult to block vibration transmitted to the second support region 120 at an early stage.

In FIG. 9, the rotation shaft 61 of the second transport roller 60 is a single member, but alternatively, the rotation shaft 61 of the second transport roller 60 may include a plurality of members that are spaced apart from each other in an axial direction. In such a case, the axial length $L_S$ denotes an overall length of the plurality of members in the axial direction.

Figure 10A:
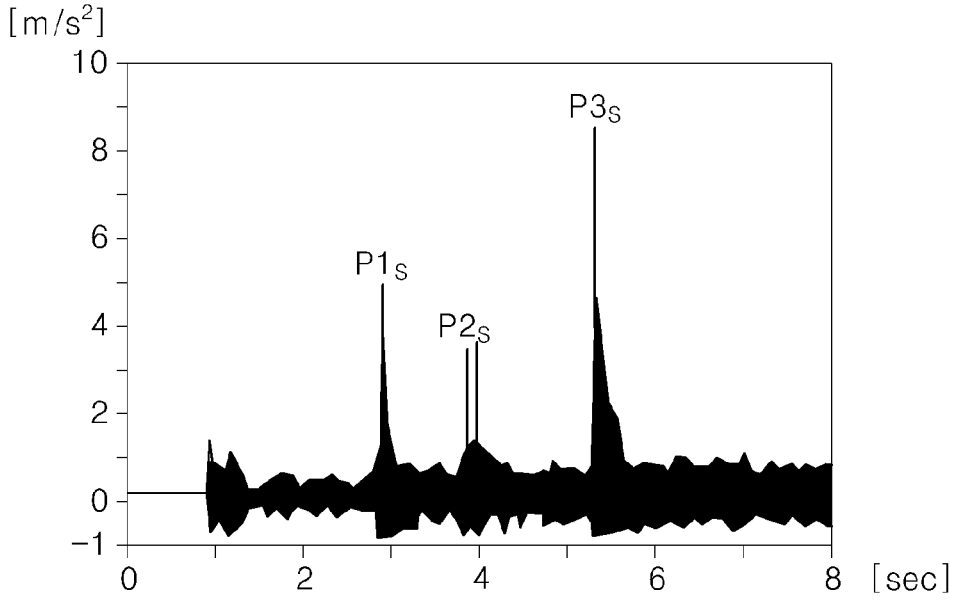
FIGS. 10A and 10B are graphs illustrating acceleration values during printing, while a second transport roller and an exposure unit are supported by a base frame on which a vibration blocking slit is not formed, according to Comparative Example.
Figure 10B:
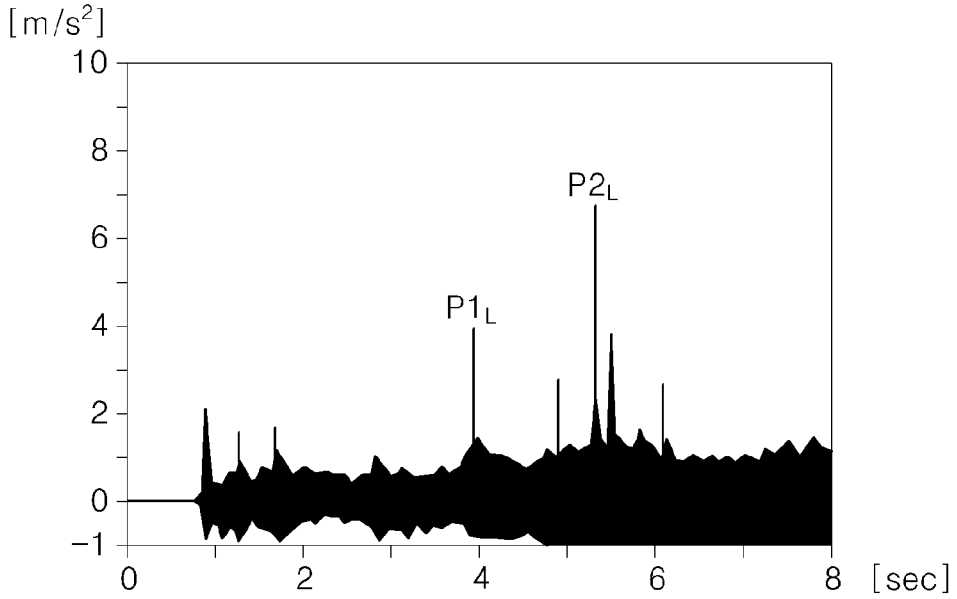
Figure 11A:
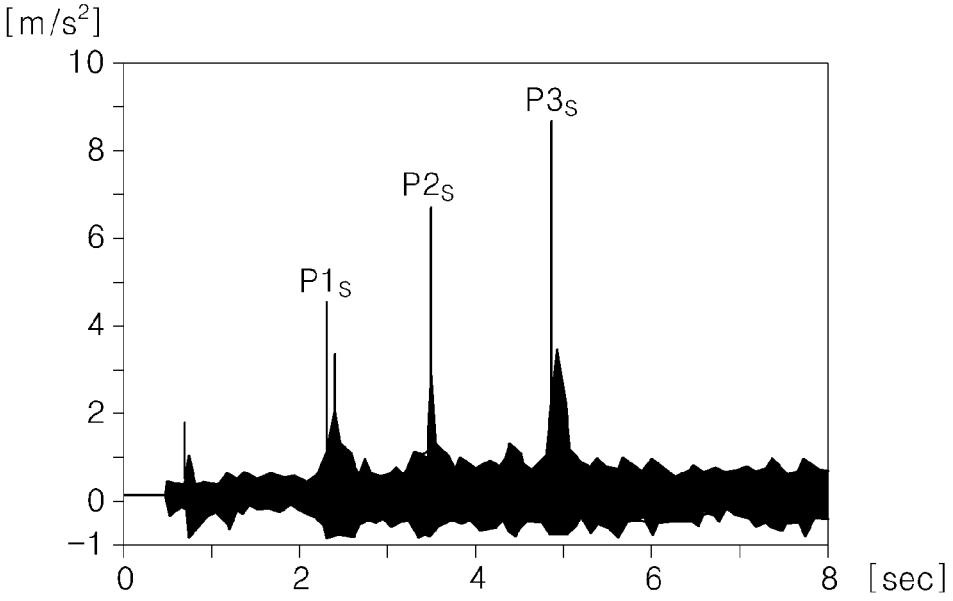
FIGS. 11A and 11B are graphs illustrating acceleration values during printing, while a second transport roller and an exposure unit are supported by a base frame on which a vibration blocking slit is formed, according to an exemplary embodiment of the present general inventive concept.
Figure 11B:
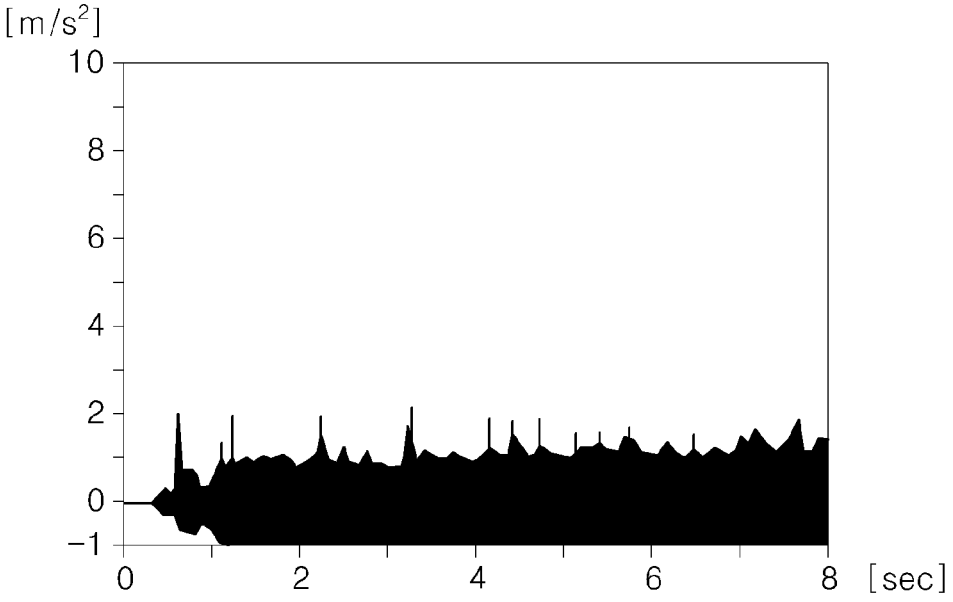

FIGS. 10A and 10B are graphs showing acceleration values during printing, while the second transport roller 60 and the exposure unit 72 are supported by the base frame 100 in which the vibration blocking slit 130 is not formed, according to Comparative Example, and FIGS. 11A and 11B are graphs showing acceleration values during printing while the second transport roller 60 and the exposure unit 72 are supported by the base frame 100 in which the vibration blocking slit 130 is formed, according to an exemplary embodiment of the present general inventive concept.

The base frame 100 according to the current embodiment includes the vibration blocking slit 130 whose distance D from the rotation shaft 61 of the second transport roller 60 is about 31 mm, length $L_H$ is about 310 mm, and width W is about 5 mm, whereas the base frame 100 according to Comparative Example does not include the vibration blocking slit 130. Other components of an image forming apparatus according to the current embodiment and Comparative Example are configured as shown by FIG. 1, and the acceleration values were measured for about 8 seconds.

In FIGS. 10A and 11A, acceleration values of the rotation shaft 61 of the pickup unit 20 are measured, and changes of the acceleration values of the pickup unit 20 during printing are shown. Referring to FIG. 10A, an acceleration value having a predetermined value starts to be measured from around 1 second after the image forming apparatus is turned on. Then, a first peak $P1_S$, wherein an acceleration value suddenly increases, occurs around 3 seconds when a driving signal is transmitted to the pickup unit 20. Then, the acceleration value decreases, and a second peak $P2_S$, wherein an acceleration value suddenly increases, occurs around 4 seconds when the driving signal transmitted to the pickup unit 20 is blocked. Then, the acceleration value again decreases, and a third peak $P3_S$, wherein an acceleration value suddenly increase, occurs around 5.3 seconds when the rear edge $P_b$ of the recording medium P is released from between the pickup unit 20 and the friction unit 30. In FIG. 11A, the first through third peaks $P1_S$ through $P3_S$ show similar aspects, despite of small differences in acceleration values.

In FIGS. 10B and 11B, acceleration values of the second support region 120 where the exposure unit 72 is supported are measured, and changes of the acceleration values of the second support region 120 in which the exposure unit 72 is supported during printing are shown.

Referring to FIG. 10B, an acceleration value starts to be measured around 1 second after the image forming apparatus is turned on, like FIG. 10A. Then, a first peak $P1_L$, wherein an acceleration value suddenly increases, occurs around 4 seconds when a driving signal transmitted to the pickup unit 20 is blocked. Then, an acceleration value decreases, and a second peak $P2_L$, wherein an acceleration value suddenly increases, occurs around 5.3 seconds when the rear edge $P_b$ of the recording medium P is released from between the pickup unit 20 and the friction unit 30. The acceleration value is about 4 $m/s^2$ at the first peak $P1_L$, and is about 7 $m/s^2$ at the second peak $P2_L$.

On the other hand, referring to FIG. 11B, the change of the acceleration values of the second support region 120 of the base frame 100 including the vibration blocking slit 130 is completely different from that of FIG. 10B. In detail, an acceleration value starts to be measured after the image forming apparatus is turned on, but most acceleration values were lower than 2 $m/s^2$, and a maximum value of an acceleration value was about 2.36 $m/s^2$. In the second support region 120 of the base frame 100 including the vibration blocking slit 130, an acceleration value is maintained lower than 2.5 $m/s^2$ not only around 4 seconds when a driving signal is blocked in the pickup unit 20, but also around 5.3 seconds when the rear edge $P_b$ of the recording medium P is released from between the pickup unit 20 and the friction unit 30. In other words, the first and second peaks $P1_L$ and $P2_L$ of FIG. 10B are not shown in FIG. 11B. Considering that a size of an acceleration value is proportional to a force, sudden vibration is not applied to the second support region 120 in FIG. 11B. Accordingly, the vibration blocking slit 130 formed in the base frame 100 effectively blocks vibration from being transmitted to the second support region 120.

As described above, according to the one or more of the above embodiments of the present general inventive concept, an electrophotographic image forming apparatus that is capable of providing a stable image quality by using an image forming unit supported by a same frame as a transport unit, even when vibration is generated in the transport unit, may be realized.

While one or more embodiments of the present general inventive concept have been described with reference to the figures, it will be understood by those of ordinary skill in the art that various changes in form and details may be made therein without departing from the principle and spirit of the present general inventive concept, the scope of which is defined by the following claims and their equivalents.

What is claimed is:

1. An electrophotographic image forming apparatus comprising:

a recording medium storage unit in which a recording medium is stored;

a pickup unit to pick up the recording medium stored in the recording medium storage unit;

a pair of transport rollers being engaged with each other, to rotate and transport the recording medium picked up by the pickup unit;

an image forming unit to form an image on the recording medium transported by the pair of transport rollers; and a frame comprising a first support region to support at least one of the pair of transport rollers, and a second support region to support at least a part of the image forming unit, wherein the frame further comprises a vibration blocking slit that is disposed between the first and second support regions and blocks vibration from being transmitted from the first support region to the second support region.

2. The electrophotographic image forming apparatus of claim 1, wherein at least a part of the vibration blocking slit extends in a direction crossing a direction in which the first support region faces the second support region.

3. The electrophotographic image forming apparatus of claim 1, wherein a length of the vibration blocking slit is 80% to 150% of an axial length of a rotation shaft of the pair of transport rollers.

4. The electrophotographic image forming apparatus of claim 1, wherein a distance between the vibration blocking slit and a rotation shaft of the pair of transport rollers is 1.5% to 30% of an axial length of the rotation shaft of the pair of transport rollers.

5. The electrophotographic image forming apparatus of claim 1, wherein one of the pair of transport rollers is a first transport roller that rotates to transport the recording medium, and the other one of the pair of transport rollers is a second transport roller that is rotated by the first transport roller.

6. The electrophotographic image forming apparatus of claim 5, wherein the second transport roller is supported by the first support region.

7. The electrophotographic image forming apparatus of claim 1, further comprising a friction unit disposed to face the pickup unit and provide a frictional force to the recording medium transported between the pickup unit and the friction unit, in a direction opposite to a transport direction.

8. The electrophotographic image forming apparatus of claim 7, wherein the pair of transport rollers support the recording medium when a rear edge of the recording medium is released between the pickup unit and the friction unit.

9. The electrophotographic image forming apparatus of claim 1, wherein in the frame, the first support region and the second support region are integrally formed.

10. The electrophotographic image forming apparatus of claim 1, wherein the frame further comprises a first sub-frame including the first support region, and a second sub-frame including the second support region and separated from the first sub-frame, wherein the first sub-frame and the second sub-frame are fixed by a fastening member.

11. The electrophotographic image forming apparatus of claim 1, wherein the image forming unit comprises:

a photoconductive member;

an exposure unit for irradiating a light to the photoconductive member to form an electrostatic latent image;

a developing unit for forming a toner image on the photoconductive member by supplying toner to the photoconductive member where the electrostatic latent image is formed; and a transfer unit for transferring the toner image to a recording medium.

12. The electrophotographic image forming apparatus of claim 11, wherein the exposure unit is supported by the second support region.

13. An image forming apparatus, comprising:

a transport unit to transport a recording medium;

an image forming unit to form an image on the recording medium; and a frame having a first support region to support at least a part of the transport unit, a second support region to support at least a part of the image forming unit, and a vibration blocking portion disposed between first support region and the second support region to block vibration from being transmitted between the first support region and the second support region, wherein the image forming unit includes an exposure unit to form a latent image on a surface of a photoconductive member, the exposure unit being supported by the second support region.

14. The image forming apparatus of claim 13, further comprising a reinforcing member disposed in the frame beneath or above the vibration blocking portion and spaced apart from a path of vibration between the first and second support regions.

15. The image forming apparatus of claim 13, wherein the frame, first support region and second support region are integrally formed.

16. The image forming apparatus of claim 13, wherein the frame further comprises:

a first sub-frame including the first support region; and a second sub-frame including the second support region and being fastened to the first sub-frame by a fastening member.

17. The image forming apparatus of claim 16, wherein the vibration blocking portion is a slit disposed in the first sub-frame.

18. The image forming apparatus of claim 13, wherein the transport unit comprises:

one or more first transport rollers on a first rotation shaft supported on side frames connected to the frame; and one or more second transport rollers on a second rotation shaft supported on the frame.

19. The image forming apparatus of claim 18, wherein the vibration blocking portion is disposed in a direction parallel to the first and second rotation shafts.

20. The image forming apparatus of claim 18, further comprising an elastic member having one end supported on the frame and one end in contact with the second rotation shaft such that the second rotation shaft is pressed toward the first rotation shaft.

21. A frame unit of an image forming apparatus, comprising:

a first support region to support at least a part of a transport unit to transport a recording medium;

a second support region to support at least a part of an image forming unit to form an image on the recording medium, and a vibration blocking portion disposed between the first support region and the second support region to block vibration from being transmitted between the first support region and the second support region.

22. The frame unit of claim 21, wherein the vibration blocking portion is a groove formed in a direction crossing a direction in which the first support region faces the second support region.

* * * * *